United States Patent [19]

Noguchi et al.

[11] 4,166,615

[45] Sep. 4, 1979

[54] MEANS FOR DETERMINING DIFFERENCE IN COPY SHEET TRANSPORTATION STATES FOR AN ELECTROSTATIC REPRODUCTION MACHINE

[75] Inventors: Hiroshi Noguchi, Toyonaka; Yasuyoshi Kurokawa, Maebashi, both of Japan

[73] Assignee: Sharp Kabushiki Kaisha, Osaka, Japan

[21] Appl. No.: 822,347

[22] Filed: Aug. 5, 1977

Related U.S. Application Data

[63] Continuation-in-part of Ser. No. 643,854, Dec. 23, 1975, abandoned.

[30] Foreign Application Priority Data

Dec. 27, 1974 [JP] Japan ..... 49/2854

[51] Int. Cl.[2] ..... B65H 7/14; B65H 7/04; B65H 7/06

[52] U.S. Cl. ..... 271/259; 271/256; 340/674

[58] Field of Search ..... 271/259, 258, 256, 265; 340/259, 674

[56] References Cited

U.S. PATENT DOCUMENTS

| | | | |
|---|---|---|---|
| 3,130,394 | 4/1964 | Hinz et al. | 271/258 X |
| 3,495,904 | 2/1970 | Kelsch et al. | 271/258 X |
| 3,521,880 | 7/1970 | Shebanow et al. | 271/265 |
| 3,693,969 | 9/1972 | Sakamaki et al. | 271/258 |
| 3,917,142 | 11/1975 | Guarderas | 340/259 X |

OTHER PUBLICATIONS

Cutaia, A., "Document Feed Control," IBM Technical Disclosure Bulletin, vol. 4, No. 6, Nov. 1961, pp. 20 & 21.

*Primary Examiner*—Bruce H. Stoner, Jr.
*Attorney, Agent, or Firm*—Birch, Stewart, Kolasch & Birch

[57] ABSTRACT

In an electrostatic reproduction machine there is provided one or more rollers capable of rotating in union with a copy sheet being advanced, in the course of travel of the copy sheet. Sensing switches are provided for sensing nonuniformity in rotation of the rollers which may occur in abnormal copy sheet transportation states and, more particularly, in a jam state. The outputs from the sensing switches are utilized for identifying the abnormal machine states.

4 Claims, 7 Drawing Figures

MEANS FOR DETERMINING DIFFERENCE IN COPY SHEET TRANSPORTATION STATES FOR AN ELECTROSTATIC REPRODUCTION MACHINE

BACKGROUND OF THE INVENTION

The present application is a continuation-in-part of application Ser. No. 643,854, filed Dec. 23, 1975, and now abandoned.

The present invention relates to an improved copy sheet transportation state determining means for use in an electrostatic reproduction device.

In many electrophotographic machines, wherein an electrostatic latent image on the photoconductive surface of an electrophotosensitive element is developed through the use of toner particles and subsequently the toner image is transferred and permanently fixed to a copy sheet, paper jamming can occur due to any number of reasons during the toner transfer step. If the jamming is not timely sensed, the possibility of damaging the photoconductive surface arises and difficulty in removing the jamming state will be experienced. Besides, during the fixing process, the copy sheet can be burned or, in some cases, fired if undesirable situations such as jamming or a reduction of the transportation speed of the copy sheet are not sensed immediately.

In the past, for the purpose of determining a jam situation in the fixing station, a couple of sensing microswitches were provided before and behind the fixing station. A timer was adapted to initiate its performance upon arrival of the copy sheet at one of the microswitches, viz., the front switch. If a copy sheet did not pass through the other microswitch after a predetermined period of time had run out, then the jam situation would be determined to indicate that the fixing station was to be stopped. In this instance, the determinations could be carried out only after the running out of the predetermined time period, which always was accompanied by a time lag in repair procedure. Therefore, the possibility of burning or firing the copy sheet was occasionally experienced.

Accordingly, it is an object of the present invention to provide a means for quickly sensing variations in copy sheet transportation speed and thus in copy sheet transportation state and minimizing or avoiding any undesirable events due to abnormal or erroneous paper transportation when a copy sheet is not normally advanced in an electrostatic reproduction machine.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS:

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
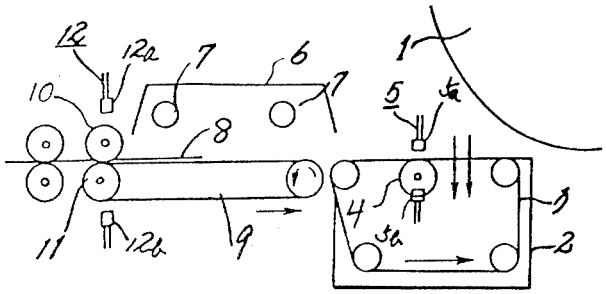
FIG. 1 is a schematic diagram of an electrostatic reproduction machine provided with the sensing means of the present invention in one preferred form.

Referring now to FIG. 1, there is illustrated a schematic diagram showing the relationship between an air absorption unit and a fixing station including a paper transportation state unit constructed in one preferred form in accordance with the present invention.

A copy sheet 8 is picked off from an electrophotosensitive drum 1 having the photoconductive surface. Attraction force (the direction of which is illustrated) created by the air absorption unit 2 causes the copy sheet 8 to be placed on a conveying belt 3 which leads the copy sheet 8 past free-rotating copy sheet speed sensing member 4 (in the form of a roller) to the entrance to the fixing station 6 containing a heater (not shown) therein. Subsequently, the copy sheet 8 travels within the interior of the fixing station on a conveying belt 9. The copy sheet 8 is further advanced and sent out of the fixing station 6 through the use of a driving roller 11 which always rotates during operation, with intervention of a second copy sheet speed-sensing member 10 (in the form of a roller) which rotates in union with the driving roller 11.

An entering copy sheet sensing switch 5 is located at a position corresponding to that of the first copy sheet speed-sensing member 4, while a leaving copy sheet sensing switch 12 is disposed at a position corresponding to that of the second copy sheet speed sensing roller 10 and the driving roller 11. The entering and leaving copy sheet sensing switches 5, 12 are of the same construction which, for example, comprise light-emitting elements **5*a* and 12*a* and light-receiving or sensing elements 5*b* and 12*b*, the copy sheet 8 being advanced between these elements. When the copy sheet 8 reaches between these elements, the light-receiving element 5*b* or 12*b*, previously placed in the conducting state due to the light from the light-emitting element 5*a*, or 12*a* incident thereon, is forced into the nonconducting state by the presence of the entering or leaving copy sheet 8** which prevents the light from striking on the respective light-receiving elements.

The first copy sheet sensing member 4 does not rotate itself and, therefore, is usually stationary. That is to say, it does not follow the movement of the copy sheet 8 at the same speed as that of the copy sheet 8 until the copy sheet 8 is advanced in contact with the sensing member 4. As contrasted with the foregoing, the second copy sheet sensing member 10 always rotates due to a little friction with the driving roller 11. When the copy sheet 8 passes below the second copy sheet speed-sensing member 10, the member 10 rotates with the copy sheet 8 intervened via the driving roller 11.

It is possible that nonuniformity in the speed of copy sheet transportation or subsequent transportation cessation will occur due to abnormal transportation states such as a jam state. The subject matter of the present invention is directed toward variations in the rotation speed of the copy sheet speed-sensing members 4 and 10. Abnormal transportation states can be sensed immediately by sensing nonuniformity in the rotation speed of the sensing members.

Figure 2:
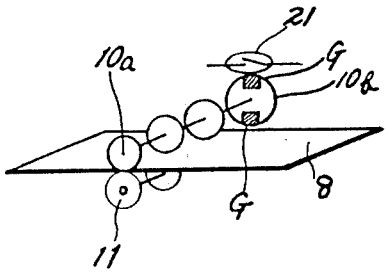
FIG. 2 is a perspective view of the sensing means shown in FIG. 1.

One preferred form of the copy sheet speed-sensing member 10 is illustrated in FIG. 2. This includes a copy sheet contacting roller 10*a*, a rotary disc 10*b* disposed in a coaxial relationship with respect to the roller 10*a* and a lead switch 21 disposed adjacent the rotary disc 10*b*. The rotary disc 10*b* has a predetermined number of magnets or painted magnetic materials G (magnetic sites) concentrically and equally disposed thereon. Both the contacting roller 10*a* and the rotary disc 10*b* rotate in synchronization with the speed of the copy sheet 8 traveling therethrough. When the magnetic materials G approach the lead switch 21, the lead switch 21 changes from the open state to the closed state to create a binary signal "1" via a suitable power source (not shown). If the magnetic materials G go away from the lead switch 21, the switch 21 will be forced into the open state which accompanies a binary signal "0". As long as the copy sheet 8 is being advanced in a normal manner, the change in the state of the lead switch 21 is cyclically repeated each time the magnetic materials pass adjacent the lead switch 21.

It follows that the binary signals "0" and "1" are alternatively or repeatedly generated. Although in the given example, means for cyclically generating the copy sheet speed-detecting signals "0" and "1" in synchronization with the copy sheet movements are implemented with the combination of the lead switch 21 and the magnetic material G, they may be substituted with conventional combinations, for example, cam-microswitch combinations, and light-emitting diode-multi aperture disc light-sensing element combinations.

Figure 3:
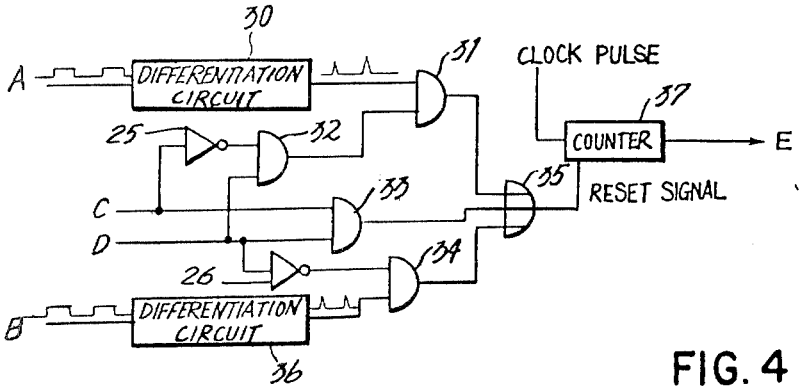
FIG. 3 is a logic diagram of an electrical circuit construction for the sensing means.

FIG. 3 illustrates a logic circuit available for determining the abnormal or erroneous states of the copy sheet transportation. The electrical signal output from the copy sheet speed-sensing member 4 is designated "A" while the counterpart from the second speedsensing member 10 is designated "B". A counter 37 starts counting the number of clock pulses when the reset signal is cleared, in other words, when the same is "0", and subsequently provides the abnormal state detection signal if the predetermined count is reached. However, when the copy sheet transportation is normal, the reset signal "1" is impressed on the counter 37 before the counter 37 reaches the predetermined count. In this instance, the abnormal state detection signal does not develop. The reset signal is derived from an OR circuit 35 responsive to three signals. Thus, a variety of elements including the inverters 25 and 26 and AND gates 31, 32, 33 and 34 are required to process the multiple output signals so as to provide reset signals, via OR gate 35 to the counter 37.

The following will set forth a way to create the above-mentioned three signals during copy sheet transportation.

The entering copy sheet sensing switch 5 and the leaving copy sheet sensing switch 12 are in their ON state before the copy sheet 8, separated from the electrophotosensitive drum 1, reaches the entering copy sheet sensing switch 5. As a result, the entering copy sheet sensing switch electrical output signal C and the leaving copy sheet sensing switch electrical output signal D assume the binary level "1" so that an AND circuit 33 provides the binary signal "1" to force the counter 37 into the reset state. At this time the abnormal state detection signal E is not developed.

Subsequently, when the copy sheet 8 arrives at the entering copy sheet sensing switch 5, the entering copy sheet sensing output will assume the binary level "0" and thus the output of the AND circuit 33 also will fall to the binary level "0". The result is that the counter is activated and resetting of the counter 37 is cleared away. As noted earlier, the copy sheet detection output A is one that cyclically changes between the levels "0" and "1". However, the signal "1" is converted via a differentiation circuit 30 only when inverting from the level "0" to the level "1". The thus obtained signal "1" is supplied to the AND circuit 31, and passes through the OR circuit 35 under the circumstances that the entering copy sheet detection output C is "0" and the leaving copy sheet detection output D is "1" (that is, the copy sheet 8 travels between the entering copy sheet sensing switch 5 and the leaving copy sheet sensing switch 12). This allows the reset signal "1" to be cyclically supplied to the counter 37. In the event that the copy sheet 8 is not advanced in a normal manner, the reset signal "1" will arrive at the counter 37 with a delay of time with the result that the predetermined count is reached and the abnormal state detection signal is developed at the counter 37. The copy sheet detection output B is not derived from the AND circuit 34 because the leaving copy sheet sensing switch is in the ON state and that output is "1" which, in turn, provides the signal level "0" for the AND circuit 34.

When the copy sheet 8 reaches the leaving copy sheet sensing switch 12, the differentiation circuit 36 provides the cyclic repetition of the signals "0" and "1" in synchronization with the speed of the copy sheet 8 which via the AND circuit 34 forces cyclically the counter into the reset state. At this time, the copy sheet speed-sensing output A does not pass through the AND circuit 31 because of the leaving copy sheet sensing output being "0". The copy sheet speed-sensing output B always provides counter 37 in a cyclic fashion with the reset signals when the leaving copy sheet sensing output is "0".

If the copy sheet 8 is not normally advanced as passing through the leaving copy sheet sensing switch 12, the reset signal periodically applied to the counter 37, will increase in the period it takes to reach the counter which gives rise to the occurrence of the abnormal state detection signal. When the copy sheet 8 goes away from the leaving copy sheet sensing switch and thus the fixing station, both the entering and leaving copy sheet sensing switches 5 and 12 are in the ON state so that the counter 37 is maintained in the reset state until the copy sheet 8 again reaches the entering copy sheet sensing switch 5.

Figure 4:
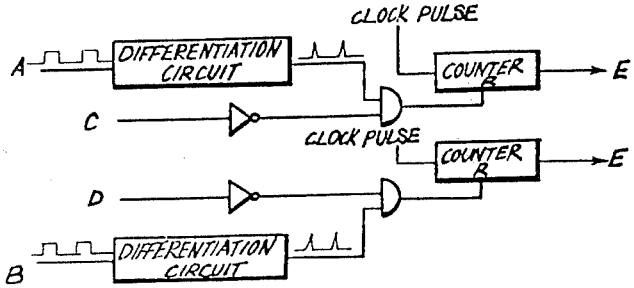
FIG. 4 is a modification of the circuit construction shown in FIG. 3.

In addition to the circuit arrangement illustrated in FIG. 3, an alternative circuit arrangement of FIG. 4 can be employed wherein the copy sheet speed-sensing member 4 of the absorption unit 2 and the copy sheet speed-sensing member 10 serve independently of each other. The copy sheet speed detection outputs A and B are supplied to the AND circuits 31, 34 via the differentiation circuit due to the reason that the counter will be placed into the reset state without the occurrence of the jam detection signals in the event that the magnetic material G accidentally stops at a position which renders the lead switch 21 conducting.

Figure 5:
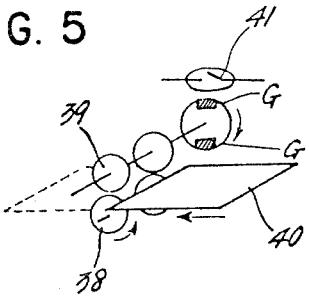
FIGS. 5 and 6 are schematic diagrams of an electrostatic reproduction machine embodying an alternate embodiment of the present invention.
Figure 6:
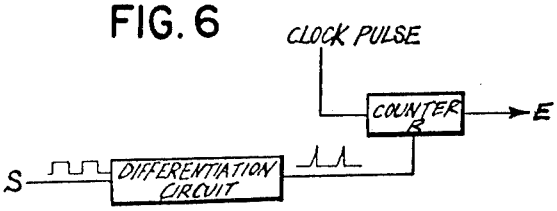

FIG. 5, along with the logic circuit of FIG. 6, illustrates another preferred embodiment of the copy sheet transportation state determining member. A driving roller 38 starts to rotate upon the introduction of power. When the copy sheet 40 does not reach a copy sheet speed-sensing roller 39, the copy sheet speed-sensing roller 39 is driven directly by the driving roller 38. If the copy sheet 40 contacts the sensing roller 39, the sensing roller will be driven with intervention of the copy sheet 40 at the same speed as the transportation speed of the copy sheet 40. The speed-sensing magnet G is secured on one end of the copy sheet speed-sensing roller 39. A lead switch 41 is provided adjacent the magnet G in a manner such that the lead switch 41 is placed into the ON state when the magnet G approaches the lead switch 41. Therefore, the sensing output S of FIG. 6 is derived from the lead switch 41, which is proportional to the rotation speed of the copy sheet speed-sensing roller 39. As viewed in FIG. 6, the reset signal, as set forth above, is generated by differentiating the sensing output S. Similarly, when the predetermined count is reached, the jam signal will develop.

Figure 7:
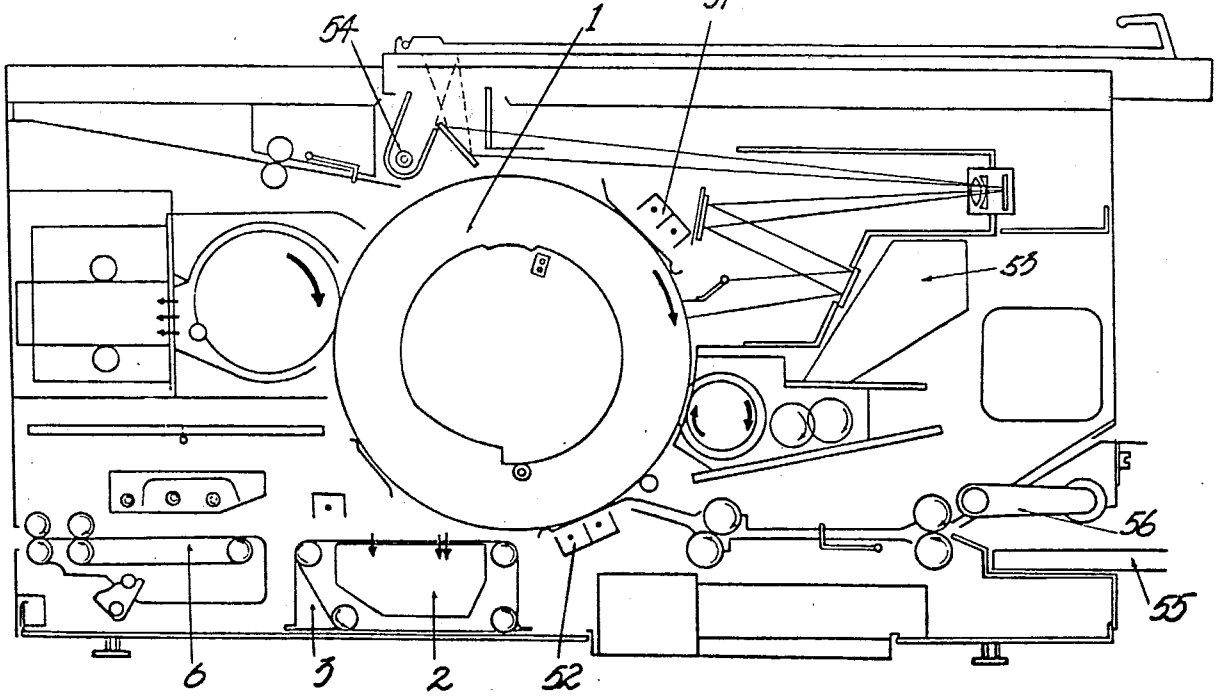
FIG. 7 is a schematic diagram of the whole construction of the electrostatic reproduction machine.

FIG. 7 is a schematic diagram of an electrostatic reproduction machine which includes, in addition to the electrophotosensitive drum 1, the copy sheet absorption unit 2 with conveying belt 3 and the fixing station 6 discussed in detail above, a charging station 51, a toner transfer station 52, a toner box 53, an illumination lamp 54, a copy sheet cassette 55, and a copy sheet supply roller 56. The detailed description of these components is omitted because these independent components are well known in the art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A copy sheet transportation state detection arrangement for use in an electrostatic copying machine which comprises:

(a) entering and leaving copy sheet sensing switches each with electrical signal output capability provided for sensing the presence or absence of a copy sheet;

(b) a first copy sheet speed-sensing member with electrical signal output capability provided for monitoring the uniformity or nonuniformity in the speed of copy sheet transportation, said first speed-sensing member being juxtapositioned to said entering sheet-sensing switch;

(c) a second copy sheet speed-sensing member with electrical signal output capability provided for monitoring the uniformity or nonuniformity in the speed of copy sheet transportation, said second speed-sensing member being juxtapositioned to said leaving sheet-sensing switch;

(d) a driving roller positioned opposite said second speed-sensing member such that when the copy sheet is fed through said roller-member combination said copy sheet provides the friction between the driving roller and the second speed-sensing member so as to allow the speed-sensing member to rotate; and (e) a counter for counting a predetermined number of clock pulses which, if reached, provides an abnormal state detection signal, and, (f) means for providing a reset signal to said counter to prevent the provision of said abnormal state detection signal when transportation is normal, said reset signal providing means including (1) a first AND gate receiving one actuating signal, via an inverter, from the entering switch denoting the presence of a sheet thereat and another actuating signal from the leaving switch indicating the absence of a sheet thereat, a second AND gate receiving one actuating signal from the first AND gate and another actuating signal from the first speed-sensing member via a first differentiation circuit, whereby, upon simultaneous occurence of all said actuating signals, said second AND gate provides a reset signal to said counter; (2) a third AND gate for receiving actuating signals from both the entering and leaving switches denoting the absence of sheets at both switches, whereby, upon simultaneous occurence of said actuating signals said third AND gate provides a reset signal to said counter; and (3) a fourth AND gate for receiving one actuating signal, via an inverter, from the leaving switch denoting the absence of a sheet thereat and another actuating signal, via a second differentiation circuit, from the second speed-sensing member, whereby upon simultaneous occurence of said actuating signals said fourth AND gate provides a reset signal to said counter, said counter being activated and reset signal cleared away upon the introduction of a copy sheet at said entering sensing switch.

2. The copy-sheet transportation state detection arrangement disclosed in claim 1, wherein said second speed-sensing member comprises a copy sheet contacting roller, a rotary disc disposed in a coaxial relationship with said contacting roller, and a lead switch disposed adjacent to said rotary disc.

3. The copy-sheet transportation detection arrangement disclosed in claim 2, wherein said rotary disc-comprises a magnetic material operatively associated with said contacting roller and said lead switch.

4. The copy-sheet transportation-state detection arrangement of claim 3, wherein said rotary disc has a predetermined number of magnetic sites concentrically and equally disposed thereon.

* * * * *